US005120424A

United States Patent [19]

Cottinet et al.

[11] Patent Number: 5,120,424

[45] Date of Patent: Jun. 9, 1992

[54] BINDER PITCH FOR AN ELECTRODE AND PROCESS FOR ITS MANUFACTURE

[75] Inventors: Denis Cottinet, Haubourdin; Serge Buche, Lens; Pierre Couderc, Bethune; Jean L. Saint Romain, Saint Laurent Blangy, all of France

[73] Assignee: Norsolor, Paris la Defense, France

[21] Appl. No.: 643,143

[22] Filed: Jan. 16, 1991

Related U.S. Application Data

[63] Continuation of Ser. No. 415,291, filed as PCT/FR88/00145, Mar. 21, 1989, abandoned.

[30] Foreign Application Priority Data

Mar. 24, 1987 [FR] France ..... 87 04054

[51] Int. Cl.[5] ..... C10C 3/00

[52] U.S. Cl. ..... 208/39; 208/22; 208/40; 208/44; 208/41; 208/42

[58] Field of Search ..... 208/22, 39

[56] References Cited

U.S. PATENT DOCUMENTS

| | | | |
|---|---|---|---|
| 4,017,378 | 4/1977 | Fauveau et al. | 208/41 |
| 4,096,056 | 6/1978 | Haywood | 208/22 |
| 4,197,282 | 4/1980 | Bailly-Lacresse et al. | 423/447.4 |
| 4,427,530 | 1/1984 | Dickakian | 208/22 |
| 4,454,019 | 6/1984 | Izumi | 208/22 |
| 4,454,020 | 6/1984 | Izumi | 208/22 |
| 4,518,482 | 5/1985 | Dickakian | 208/22 |
| 4,518,483 | 5/1985 | Dickakian | 208/22 |
| 4,545,879 | 10/1985 | Wan et al. | 208/244 |
| 4,548,703 | 10/1985 | Dickakian | 208/22 |
| 4,581,123 | 4/1986 | Dickakian | 208/39 |
| 4,589,974 | 5/1986 | Izumi | 208/39 |
| 4,664,774 | 5/1987 | Chu et al. | 208/22 |

*Primary Examiner*—Helane Myers

*Attorney, Agent, or Firm*—Finnegan, Henderson, Farabow, Garrett & Dunner

[57] ABSTRACT

The disclosed bonding pitch for electrodes, having a softening point C.I.A. comprised between 80° C. and 150° C., a concentration of quinoline-insoluble substances higher or equal to 4% by weight, a concentration of $\alpha+\beta$ resins comprised between 28 and 40% by weight, and a fixed carbon content determined according to the standard ISO 6998, at least equal to 51% by weight, is characterized by a vitreous transition domain $\Delta Tg$, determined by differential calorimetric analysis, at the most equal to 50° C. In order to produce such a pitch, a pitch having a content of quinoline-insoluble substances lower than 4% by weight is subjected to a treatment by waves having a frequency between 0.9 and 300 GHz. Such treatment makes possible the increase of the carbon content of the pitch while preserving a good affinity to the coke and significantly decreasing its vitreous transitional domain.

11 Claims, No Drawings

BINDER PITCH FOR AN ELECTRODE AND PROCESS FOR ITS MANUFACTURE

This application is a continuation of application Ser. No. 07/415,291, filed as PCT/FR88/00145, Mar. 21, 1988, now abandoned.

The present invention relates to pitches, in particular pitches obtained from coal tars, without, however, being limited to the latter.

The coal tar pitcher consist of the concentrate from the distillation of coal tars. Pitches are complex mixtures:

1) of polyaromatic molecules, optionally carrying short aliphatic chains, 2) of polar molecules, acidic or basic in character (phenols, naphthols, carbazole, pyridinic bases, and the like), and 3) optionally, insoluble particles in suspension (particles of the carbon black type, cenospheres or coke particles contaminated to a greater or lesser extent by inorganic impurities).

Pitches and tars are characterized by means of their content of substances which are insoluble in various solvents; thus, it is common to consider the following three fractions:

1) the $\alpha$ resins, consisting of the quinoline-insoluble fraction, 2) the $\beta$ resins, consisting of the toluene-insoluble and quinoline-soluble fraction, and 3) the $\gamma$ resins, consisting of the toluene-soluble fraction.

The tars used for the preparation of pitches can thus be distinguished according to their content of $\alpha$ resins; the name "low $\alpha$" tars will be given to the tars containing less than 2% by weight of $\alpha$ resins.

The distillation of coal tars makes it possible to obtain substantially equal quantities of, on the one hand, oils (benzene, toluene, xylene, the corresponding phenolic and methylated products, naphthalene, middle oils, anthracene, chrysene and the like) and, on the other hand, the concentrate or pitch.

Among the applications of pitches, particular mention may be made of their use as binders in the manufacture of carbon or graphite electrodes, which are employed for the production of aluminum and of ferrous and nonferrous metals.

Pitches are characterized by various analytical data, the knowledge of which makes it possible to assess their use value for the chosen application; a definition of the various characteristics of pitches which will be referred to in the present specification will be given below:

the C.I.A. (Cube In Air) softening point, expressed in °C., a value determined according to the ASTM standard D 3104-77;

the content of $\alpha$ resins and the content of $\alpha+\beta$ resins (or toluene-insoluble fraction) (which are expressed in % by weight) obtained by the operating procedures given in the ISO standards 6791 and 6376 respectively;

the fixed carbon content (expressed in % by weight) which reflects the coke yield or the carbon value of the pitch, this content being calculated according to the ISO standard 6998;

the pitch-coke affinity measured according to the penetration test described by P. Couderc, P. Hyvernat and G. L. Lemarchand in the periodical Fuel, 1986, Vol. 65, 2, 281–287; this test makes it possible to characterize the penetration and flow properties of pitches in a coke bed (fast or delayed flow; complete or incomplete penetration). The flow curves obtained make it possible to obtain two characteristic temperatures:

$T_2$: final penetration temperature $T_1$: temperature of the beginning of the flow curve, obtained by extrapolation;

the measurement of the glass transition temperature and range: Tg and ←Tg, by means of differential calorimetric analysis (carried out under the following conditions: a 20 mg sample of pitch is heated to 140° C. and is then cooled to −100° C. in 3 minutes, and is then reheated at the rate of 30° C. per minute).

A binder pitch considered satisfactory for the manufacture of a carbon or graphite electrode generally meets the following specifications:

a C.I.A. softening point of the order of 100° to 130° C.;

a content of $\alpha$ resins of the order of 8 to 15% by weight;

a content of $\alpha+\beta$ resins of the order of 28 to 35% by weight;

a fixed carbon content of the order of 54 to 62% by weight; and a good pitch-coke affinity (rapid or relatively undelayed flow, complete penetration).

Pitches corresponding to these specifications are obtained, merely by distillation, when starting from a tar containing more than 4% of $\alpha$ resins. Differential thermal analysis shows these pitches always to have a glass transition range $\Delta Tg$ of the order of 55° C.

On the other hand, when a "low $\alpha$" tar is distilled, then, for the same softening point, a pitch is obtained whose content of $\alpha$ resins does not exceed 5% by weight, whose content of $\alpha+\beta$ resins is of the order of 25% by weight and whose fixed carbon content is below 54% by weight. Although having good affinity towards coke, this pitch is considered to be too lean in carbon. To overcome this shortcoming it is possible to carry out a heat treatment at temperatures above 350° C. Under these conditions, the pitches obtained have acceptable fixed carbon and $\alpha+\beta$ resin contents. On the other hand, their affinity for coke is difficult to control. In addition, a marked increase in the glass transition range $\Delta Tg$ is observed.

Furthermore, experience shows that when such treatments are carried out under industrial conditions, they are accompanied by coking and cracking phenomena related to the existence of heat gradients in the vicinity of the oven wall.

The present invention is based on the finding that the quality of a binder pitch for an electrode can be improved further when it additionally exhibits a glass transition range $\Delta Tg$ which is clearly more restricted than those known hitherto. However, as just indicated, no manufacturing process made it possible to obtain this result until now.

The Applicant Company has now found that it is possible to produce a maturing of the pitch by means of a treatment with high-frequency waves. This treatment makes it possible to raise the fixed carbon content of the pitch, while preserving its good affinity towards coke and while significantly reducing its glass transition range.

The subject of the present invention is consequently firstly a binder pitch for an electrode, having:

a C.I.A. softening point of between 80° C. and 150° C., a content of quinoline-insoluble substances higher than or equal to 4% by weight, a content of $\alpha+\beta$ resins of between 28 and 40% by weight, and a fixed carbon content, determined according to the ISO standard 6998, of at least 51% by weight, characterized in that its glass transition range $\Delta Tg$, determined by differential calorimetric analysis, is less than or equal to 50° C.

In a more particularly preferred manner, the pitch according to the invention has a $\Delta Tg$ range of less than or equal to 40° C.

In addition to the abovementioned characteristics, the pitch according to the invention may advantageously have one or other of the following flow properties, which are determined according to the abovementioned penetration test (using a coke bed mean particle size of approximately 120 μm and a heating rate of 20° C. per hour):

a flow delay $T_2-T_1$ not exceeding 15° C.;

a final penetration temperature $T_2$ not exceeding 180° C.

Another subject of the present invention is a process for the manufacture of a pitch such as defined above, according to which process a pitch exhibiting a content of quinoline-insoluble substances of less than approximately 4% by weight is subjected to a treatment by waves which have a frequency of between 0.9 and 300 GHz.

The high-frequency wave treatment consists in converting electrical energy into heat in dielectric (insulating) materials containing polar molecules. The polar molecules subjected to the electromagnetic field are violently moved apart or brought closer together, causing a heat release by collision.

Advantageously, a conventional frequency of approximately 2.45 GHz is employed.

In accordance with the present invention, the treatment is carried out in principle at atmospheric pressure; however, it may be carried out, without disadvantage, at a pressure which may go up to 20 bars.

The temperature at which the treatment is carried out is controlled by the quantity of electrical energy supplied to the system (magnetron). It is preferably between 350° and 450° C., in particular between 380° and 420° C.

The duration of the treatment is preferably between 1 and 1,200 minutes. It is proportionately shorter, the higher the temperature.

In addition, after the treatment according to the invention, it will be possible, as usual, to carry out a complementary distillation, for example under reduced pressure, in order to reach the desired C.I.A. softening point.

Furthermore, the process of the present invention may be performed continuously or noncontinuously.

A major advantage of the process according to the invention, compared with the conventional processes employing electrical heating, lies in a major decrease in the duration of treatment, permitting an increase in the output rate. In addition, this method of heating makes it possible to avoid the coking and cracking phenomena referred to above. It is therefore possible to operate using higher temperatures and shorter times, without disadvantage.

In the examples which follow, the continuous heat treatment for pitch maturing has been compared, on the one hand, using conventional heating employing a Joule effect in an electric oven and, on the other hand, using a treatment by means of high-frequency waves according to the invention, in a microwave oven.

EXAMPLES 1 and 2 (COMPARATIVE)

HEAT TREATMENT OF PITCH IN AN ELECTRIC OVEN a) Principle

The pitch is preheated to a temperature of the order of 200° C. in a melting kettle before being conveyed towards an electrically heated tubular oven operating continuously.

b) Description of the apparatus

The melting kettle employed consists of a closed reactor, 130 liters in capacity, equipped with mechanical stirring and heated externally, with regulation, by means of electrical resistors placed in a steel jacket and capable of delivering a total power of 30 kW. The steel jacket forms a "heat store" and makes it possible to remove the excess heat energy by injecting compressed air, if deemed necessary. The pitch can thus be rapidly heated to the desired temperature, while avoiding localized overheating.

The pitch preheated in the melting kettle in this manner, whose viscosity is of the order of 50 centipoises, is then conveyed continuously towards the oven by virtue of a gear pump. The latter consists of a stainless steel body equipped with a preheating jacket; it permits flow rates of the order of 2 to 20 liters per hour to be obtained. The jacket and all the pipes conveying the pitch are heated by virtue of an oil bath, to a temperature of the order of 200° C.

The tubular oven is made of stainless steel and has a capacity of 4 liters. It is heated by means of electrical resistors delivering a total power of 4 kW and is also placed in a steel jacket, its purpose being the same as in the case of that fitted to the melting kettle. The maintenance of the maturation temperature in the oven is ensured by regulation. A pyrex column head is placed above the oven, making it possible to condense the volatile products in order to limit their loss, since such products play a major part in the polycondensation reaction.

The pitch leaving the oven at the maturation temperature is cooled by the same oil bath which acts as the exchanger. Vessel bottom and drainage valves are placed in the system, in various places, and permit the pitch to be rapidly discharged at the end of reaction or at any time. The pitch is then collected and weighed continuously.

c) Conditions of maturation

Using the abovementioned device, it has been possible to operate at a temperature of up to about 405° C. However, it is very difficult to exceed this temperature, because of the very considerable departure of volatile products during the maturation, at atmospheric pressure, such departures being promoted by the cracking reactions due to the heat effects in the vicinity of the wall. In fact, a temperature difference is observed between the wall and the heart of the oven which is of the order of 20° C. at the abovementioned treatment temperature, for a flow rate of the order of 2.7 liters per hour.

According to Example 1, the heat treatment under the conditions described above, at a temperature of 405° C. and for 175 minutes, is applied to a coal tar pitch which has a C.I.A. softening point of 84.7° C., a content of quinoline-insoluble substances ($\alpha$ resins) equal to 3.3% by weight, a content of $\alpha+\beta$ resins equal to 24.1% by weight and a fixed carbon content equal to 48.0% by weight. The binder pitch obtained at the end of this treatment has the characteristics shown in the table below.

According to Example 2, the binder pitch obtained in Example 1 is subjected to a flash distillation at a pressure of 0.145 bar so as to remove 4.5% of the oil which it contains. The binder pitch obtained at the end of this distillation has the characteristics shown in the table below.

EXAMPLES 3 to 5

HEAT TREATMENT OF THE PITCH IN A MICROWAVE OVEN a) Description of the apparatus

The apparatus described earlier is employed, with the electrical oven replaced with a microwave appliance. The latter consists of eight guide sections which are stacked and offset by 90° relative to one another. Each of these sections is connected to a magnetron capable of an output of 800 W, but deliberately limited to 400 W to protect the magnetron against a bad adaptation. These magnetrons operate at a frequency of 2.45 GHz. Passing through the stack of waveguides is a quartz reactor, with a working capacity of 1,000 $cm^3$, in which the liquid pitch circulates. A quartz sheath is immersed in the reactor and, when the magnetrons are not operating, makes it possible to measure the temperature within the liquid. A thermocouple at the outlet of the reactor enables the temperature to be regulated.

b) Treatment conditions

In contrast to the heat treatment in an electrical oven, the treatment carried out in the apparatus described above makes it possible:

- to treat pitches, with a flow rate of 2.7 1/h, at any temperature up to 450° C.;
- to cut out the preheating period; and
- to reduce the working power to 2.7 kW instead of 3.2 kW.

According to Example 3, the high-frequency wave treatment, under the conditions described above, at a temperature of 415° C. and for 45 minutes, is applied to the same coal tar pitch as that described in Example 1. The binder pitch obtained at the end of this treatment has the characteristics shown in the table below.

According to Examples 4 and 5, the binder pitch obtained in Example 3 is subjected to a flash distillation at a pressure of 0.145 bar, so as to remove 4.5% by weight (Example 4) and 1.3% by weight (Example 5) of the oil which it contains, respectively. The binder pitches obtained at the end of these distillations have the characteristics shown in the table below.

TABLE

| Example | No. 1 | No. 2 | No. 3 | No. 4 | No. 5 |
|---|---|---|---|---|---|
| CIA softening point (°C.) | 96 | 112.8 | 99 | 118 | 105 |
| Content of $\alpha$ resins (% by weight) | 4.6 | 7.3 | 4 | 8.5 | 5.5 |
| Content of $\beta + \alpha$ resins (% by weight) | 29 | nd | 28.6 | 37 | 32 |
| Fixed carbon content (% by weight) | 51.5 | 56.3 | 51.3 | 58.6 | 53.5 |
| $\Delta$Tg | 56 | 59 | 35 | 36 | 37 |

nd = not determined

We claim:

1. Binder pitch for an electrode, having:
   a. C.I.A. Cube In-Air softening point of between 80° C. and 150° C.,
   a content of quinoline-insoluble substances higher than or equal to 4% by weight,
   a content of $\alpha+\beta$ resins of between 28 and 40% by weight, and
   a fixed carbon content, determined according to the ISO standard 6998, of at least 51% by weight,
   characterized in that its glass transition range $\Delta$Tg, determined by differential calorimetric analysis, is less than or equal to 50° C.

2. Pitch according to claim 1, characterized in that its glass transition range $\Delta$Tg is less than or equal to 40° C.

3. Pitch according to claims 1, characterized in that it has a flow delay T2 - T1, according to the pitch-coke affinity test, not exceeding 15° C.

4. Pitch according to claim 1, characterized in that it has a final penetration temperature $T_2$, according to the pitch-coke affinity test, not exceeding 180° C.

5. A process for the manufacture of a binder pitch for an electrode having:
   a Cube In Air softening point of between 80° C. and 150° C.,
   a content of quinoline-insoluble substances higher than or equal to 4% by weight,
   a content of $\alpha+\beta$ resins of between 28 and 40% by weight, and
   a fixed carbon content, determined according to the ISO Standard 6998, of at least 51% by weight, characterized in that is glass transition range $\Delta$Tg, determined by differential calorimetric analysis, is less than or equal to 50° C. and further characterized in that a pitch exhibiting a content of quinoline-insoluble substances of less than 4% by weight is subjected to a treatment by electromagnetic waves which have a frequency of between 0.9 and 300 GHz.

6. Process according to claim 5, characterized in that a frequency of 2.45 GHz is employed.

7. Process according to claims 5, characterized in that the treatment is carried out at atmospheric pressure.

8. Process according to claim 5, characterized in that the treatment is carried out at a pressure which may go up to 20 bars.

9. Process according to claims 5, characterized in that the operation is carried out at a temperature of between 350° and 450° C.

10. Process according to claims 5, characterized in that the treatment is carried out for a duration of 1 to 1,200 minutes.

11. Process according to claim 5, characterized in that after the treatment a complimentary distillation is carried out to reach the desired Cube In Air softening point.

* * * * *

UNITED STATES PATENT AND TRADEMARK OFFICE

CERTIFICATE OF CORRECTION

PATENT NO. : 5,120,424

DATED : June 9, 1992

INVENTOR(S) : Denis COTTINET et al.

It is certified that error appears in the above-identified patent and that said Letters Patent is hereby corrected as shown below:

Claim 1, column 6, line 15, delete "a. C.I.A. Cube In-Air" and insert --a Cube In Air--.

Claim 3, column 6, line 28, delete "claims" and insert --claim--; and

Claim 3, column 6, line 29, delete "T2-T1" and insert --$T_2$-$T_1$--.

Claim 9, column 6, line 58, delete "claims" and insert --claim--.

Claim 10, column 6, line 61, delete "claims" and insert --claim--.

Signed and Sealed this

Twentieth Day of July, 1993

*Attest:*

Michael K. Kirk

MICHAEL K. KIRK

*Attesting Officer*

*Acting Commissioner of Patents and Trademarks*